US010087651B2

(12) United States Patent
Cavanagh

(10) Patent No.: US 10,087,651 B2
(45) **Date of Patent: *Oct. 2, 2018**

(54) INTEGRATED SNAP TOGETHER FENCE SYSTEM

(71) Applicant: SnapFence LLC, Acton, CA (US)

(72) Inventor: John Cavanagh, Acton, CA (US)

(73) Assignee: SNAPFENCE LLC, Acton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/813,002

(22) Filed: Nov. 14, 2017

(65) Prior Publication Data

US 2018/0066448 A1 Mar. 8, 2018

Related U.S. Application Data

(63) Continuation-in-part of application No. 13/663,313, filed on Oct. 29, 2012, now Pat. No. 9,816,286.

(60) Provisional application No. 61/554,241, filed on Nov. 1, 2011, provisional application No. 62/428,512, filed on Nov. 30, 2016.

(51) Int. Cl.
*E04H 17/14* (2006.01)

(52) U.S. Cl.
CPC . *E04H 17/1421* (2013.01); *E04H 2017/1469* (2013.01)

(58) Field of Classification Search
CPC ..... E04H 17/12; E04H 17/16; E04H 17/163; E04H 17/166; E04H 17/168; E04H 2017/1452; E04H 2017/1456; E04H 2017/1469; E04H 2017/1476; E04B 2002/7487; A47B 47/008; F16B 2012/446; Y10T 403/342; Y10T 403/347
See application file for complete search history.

(56) References Cited

U.S. PATENT DOCUMENTS 2,926,941 A * 3/1960 Thompson ..... A47B 47/0008 403/173
3,357,727 A * 12/1967 Finkenstein ..... F16L 317/004 403/176
3,711,133 A * 1/1973 Werner ..... F16B 7/00 248/188.1
3,883,257 A * 5/1975 Delafield ..... A47B 47/0008 297/440.24
3,912,410 A * 10/1975 Pofferi ..... A47B 47/03 108/192
4,951,925 A 8/1990 Schultz et al.
4,982,933 A 1/1991 Schultz
(Continued)

FOREIGN PATENT DOCUMENTS

EP 2113618 A1 11/2009

OTHER PUBLICATIONS

"James Hardie—World Leader in Fiber Cement Siding and Backerboard" retrieved from www.jameshardie.com on Nov. 18, 2016, pp. 1-4.

*Primary Examiner* — Joshua T Kennedy
(74) *Attorney, Agent, or Firm* — Paul Y. Feng; One LLP

(57) ABSTRACT

A snap together tubing system having a plurality of molded plastic members which function to provide the posts and nails of a fence and are configured to be assembled with connectors formed of molded plastic to attach the nails to the posts by snapping them together. A flat sheet backer board is affixed or fastened to the to the tubing system to create a wall.

11 Claims, 14 Drawing Sheets

(56) References Cited

U.S. PATENT DOCUMENTS

| | | | | |
|---|---|---|---|---|
| 5,255,897 | A | 10/1993 | Pepper | |
| 5,702,090 | A | 12/1997 | Edgman | |
| 6,305,670 | B1 * | 10/2001 | Ward | E04F 11/1842 256/59 |
| 6,413,004 | B1 * | 7/2002 | Lin | B25B 7/02 403/171 |
| D477,527 | S * | 7/2003 | Bradford | D8/382 |
| 6,935,623 | B2 | 8/2005 | Cook et al. | |
| 7,014,267 | B1 * | 3/2006 | Nagar | A47B 47/0008 297/440.14 |
| 7,398,961 | B2 | 7/2008 | Froese | |
| 7,455,282 | B2 | 11/2008 | Platt | |
| 7,690,628 | B2 | 4/2010 | Hewitt et al. | |
| 7,857,291 | B2 | 12/2010 | Dombroski | |
| 7,934,699 | B2 | 5/2011 | Zell et al. | |
| 9,145,671 | B1 * | 9/2015 | Cornell | E04H 1/005 |
| 9,308,464 | B1 * | 4/2016 | Torres | A63H 33/044 |
| 9,816,286 | B2 | 11/2017 | Cavanagh | |
| 2002/0185640 | A1 | 12/2002 | Heins | |
| 2006/0113517 | A1 * | 6/2006 | Colantonio | E04H 17/168 256/24 |
| 2006/0118771 | A1 | 6/2006 | Stein et al. | |
| 2006/0202184 | A1 | 9/2006 | Tamez et al. | |
| 2009/0152523 | A1 | 6/2009 | Erwin | |

* cited by examiner

INTEGRATED SNAP TOGETHER FENCE SYSTEM

CROSS-REFERENCE TO RELATED APPLICATIONS

This application claims benefit of priority from provisional application No. 62/428,512, filed Nov. 30, 2016, and is a Continuation-In-Part of co-pending application Ser. No. 13/663,313, filed Oct. 29, 2012, which claims priority from provisional application No. 61/554,241, filed Nov. 1, 2011, the contents of all of which are hereby incorporated by reference.

FIELD OF THE INVENTION

This invention relates generally to fencing systems and more particularly to a fence system formed from molded plastic elements which may be snapped together to provide the posts and rails for supporting the fencing material.

BACKGROUND OF THE INVENTION

Fences typically are constructed by digging post holes at various intervals and then erecting the fence posts by placing them into the holes and in many instances utilizing some anchoring materials such as tamped dirt, rocks, concrete or the like to hold fence post in place and to support the tension whenever fencing material is strung between the posts. Alternatively, where chain link fencing is utilized, the posts sometimes are anchored to plates which have been secured in place in the ground by a similar technique of digging holes and anchoring the plates with concrete.

At the present time there are a number of fencing systems which utilize molded plastic parts of various configurations. Such systems generally are very complex and difficult to manufacture and to assemble particularly by the do-it-yourself persons. In some instances, fences formed from plastic material are manufactured in modules which modules must then be shipped intact to the various retail outlets and there maintained in such position. As a result, additional space is required to accommodate these modules thereby increasing the cost of shipment of the product as well as the cost of displaying the product in the retail environment.

There is thus a need for a fencing system which is constructed utilizing a minimum of parts preferably constructed of plastic material and which can be assembled by do-it-yourself individuals without the necessity of digging holes in the ground or the utilization of hand tools to any great extent.

SUMMARY OF THE INVENTION

A snap together tubing system includes a hollow elongated member which defines grooves on an external surface thereof with the elongated member being adapted to function both as posts and rails for the fence, a straight line connector including a first generally U-shaped member with an adapter extended from the bight of the U-shaped member, a corner connector formed of a second generally U-shaped member with a second adapter extending outwardly from the bight of the second U-shaped, member and a third adapter extending outwardly from an outer surface forming the arms of the second U-shaped member, the hollow elongated members when forming a post being adapted to receive said connectors and said elongated member also being adapted to be received within the adapters on the connectors to form rails with the arms on the connectors being adapted to receive the elongated members there between.

In accordance with a further aspect of the present invention there is also included a base formed of injection molded plastic material having a flat plate with a hollow riser extending upwardly therefrom, an elongated member is positioned within the hollow riser to function as a post which then receives the connectors with further elongated members received within the adapters on the connectors to function as rails.

The present invention snap together tubing system may be used as the frame for creating a wall, façade, pillar or pilaster. In such applications, a flat sheet decorative backer board or decorative wall may be attached to the snap together tubing system to create the appearance of a block wall. Rebar rods may be inserted into the hollow tubing system and driven into the ground to provide bending strength and to help with anchoring the fence to the foundation or ground. The wall may include a topper attached to the top of the tubing system for a finished appearance.

DETAILED DESCRIPTION OF THE PREFERRED EMBODIMENTS

Figure 1:
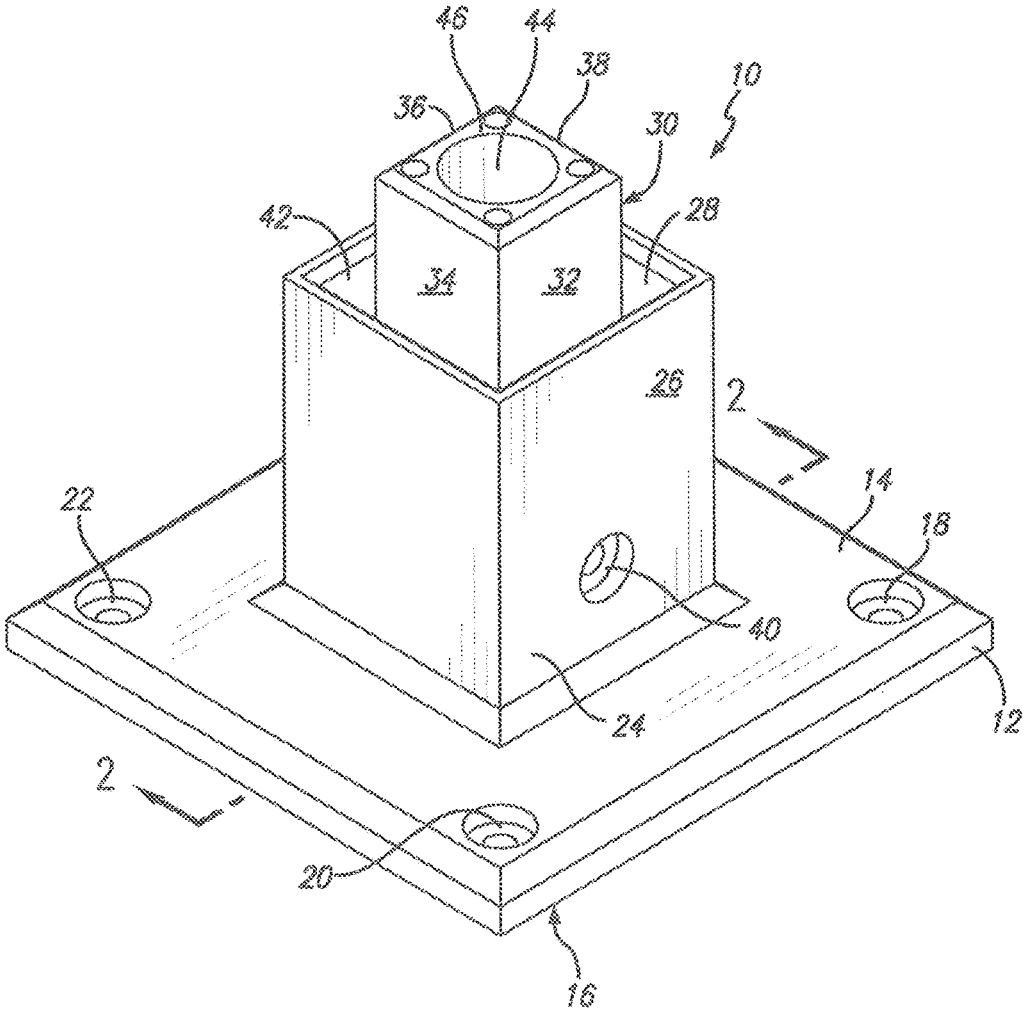
FIG. 1 is a perspective view of a base constructed in accordance with principles of present invention.

In the description which follows like elements are marked throughout the specification and drawing with the same reference numerals. The drawing figures are schematic in nature and therefore, are not to scale. The description is to provide an illustration and description of the preferred embodiment of the snap together fencing system of the present invention. It is, however, to be understood that modifications may be made to the various component parts of the snap together fencing system without departing from the scope of the claims which are appended hereto.

The present invention contemplates the provision of a fencing assembly which may be assembled and selectively configured to the erector's wishes and is designed to maintain small animals within a predetermined selected area, or alternatively, to exclude small animals from entering a particular area. The fencing system of the present invention includes a plurality of components which are preferably formed from polymer material such as a synthetic resin or a vinyl based resin, including lightweight outdoor grade rigid polyvinylchloride. The fencing system is formed from a minimum number of components which are either injection molded or extruded and which may be snapped together to form the posts and rails of a fence to which fencing material is attached to complete the fencing system. The various components which are utilized to construct the post and rails, as above referred to, will first be described, and subsequently thereto, there will be illustrated and described assembled sections of the fencing system of the present invention.

Referring now more specifically to FIG. 1, there is disclosed a base (10) which in one embodiment is utilized to support posts for the fencing system. The base is used typically on hard surfaces such as wood or concrete flooring, but may also be used outdoors on the ground. The base (10) may be placed directly upon the surface upon which the fence is to be erected, or alternatively, may be affixed to previously constructed foundations designed to receive the base. The base (10) is preferably formed from injection molded plastic material. The base includes a flat plate (12) having a top surface (14) and a bottom surface (16). The plate (10) defines a plurality of openings disposed at each corner of the plate (12) such as illustrated at (18), (20) and (22). The openings such as shown at (18), (20) and (22) are utilized when the plate (10) is to be secured by appropriate fasteners (not shown) to a floor or a previously formed support structure or the like. A hollow riser (24) extends upwardly (as shown in FIG. 1) from the top surface (14) of the flat plate (12). The hollow riser (24) includes an outer wall (26) and an inner wall (28).

A plug (30) is disposed internally of the inner surface (28) of the hollow riser (24) and includes walls (32), (34), (36) and (38) which are displaced internally from the interior wall (28) of the riser (24) in such a manner as to define a continuous cavity (42) which extends downwardly to the top surface (14) of the flat plate (12). The wall (26) of the riser (24) defines an opening (40) which may be utilized to receive a fastener to secure a post in place as will be described more fully below. Each of the openings (18), (20) and (22) and the additional opening (not shown) at the other corner of the flat plate (12) are utilized to also received fasteners which may be utilized to secure a flat plate (12) to flooring or a previously constructed foundation or the like. The fasteners may be screws or bolts or the like which are designed to extend downwardly into the openings (18), (20) and (22), or alternatively, bolts or threaded studs may be secured in place on a previously formed foundation and are allowed to extend upwardly through the openings (18), (20) and (22) and then receive a nut or other type of fastener to secure the flat plate in place.

Figure 2:
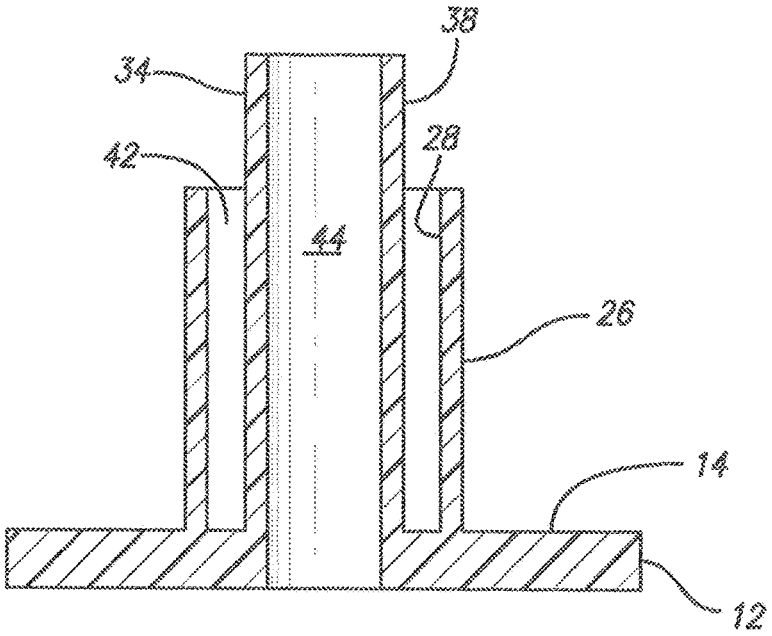
FIG. 2 is a cross-sectional view taken about the lines 2-2 of FIG. 1.

The plug (30) defines an opening (44) which extends from the top (46) of the plug (30) completely through the plug and the flat plate (12) which is clearly illustrated in FIG. 2.

Figure 4:
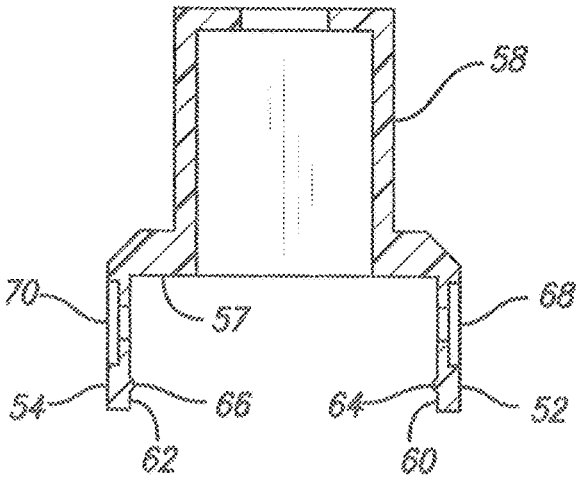
FIG. 4 is a cross-sectional view taken about the lines 4-4 of FIG. 3.
Figure 3:
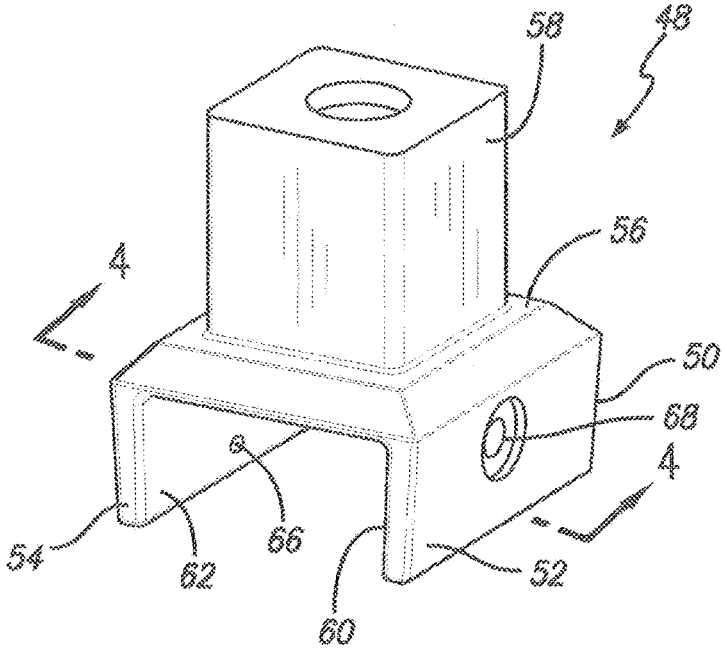
FIG. 3 is a perspective view of a straight rail to post connector used in conjunction with the fence of the present convention.

Referring now more particularly to FIGS. 3 and 4, there is illustrated a straight rail to post connector (48) which is also formed of injection molded plastic material. The straight rail to post connecter includes a generally U-shaped member (50). The U-shaped member includes arms (52) and (54) extending downwardly from the bight (56) of the generally U-shaped member (50). An adapter (58) extends outwardly from the bight (56) of the U-shaped member (50) and away from the arms (52) and (54). The opposed surfaces (60) and (62) of the arms (52) and (54), respectively have protuberances (64) and (66) extending outwardly therefrom. The downwardly extending arm (52) defines an opening (68) extending therethrough while the arm (54) defines an opening (70) extending therethrough. The openings (68) and (70) are adapted to receive fasteners as will be described more fully hereinafter.

Figure 5:
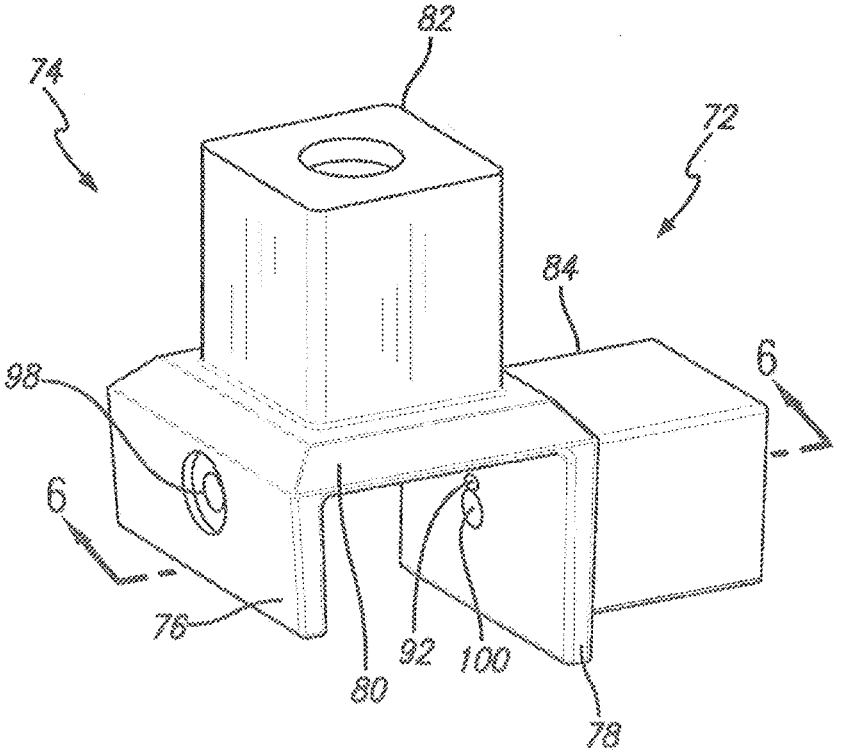
FIG. 5 is perspective view of a corner rail to post connector used with the fence of the present invention.
Figure 6:
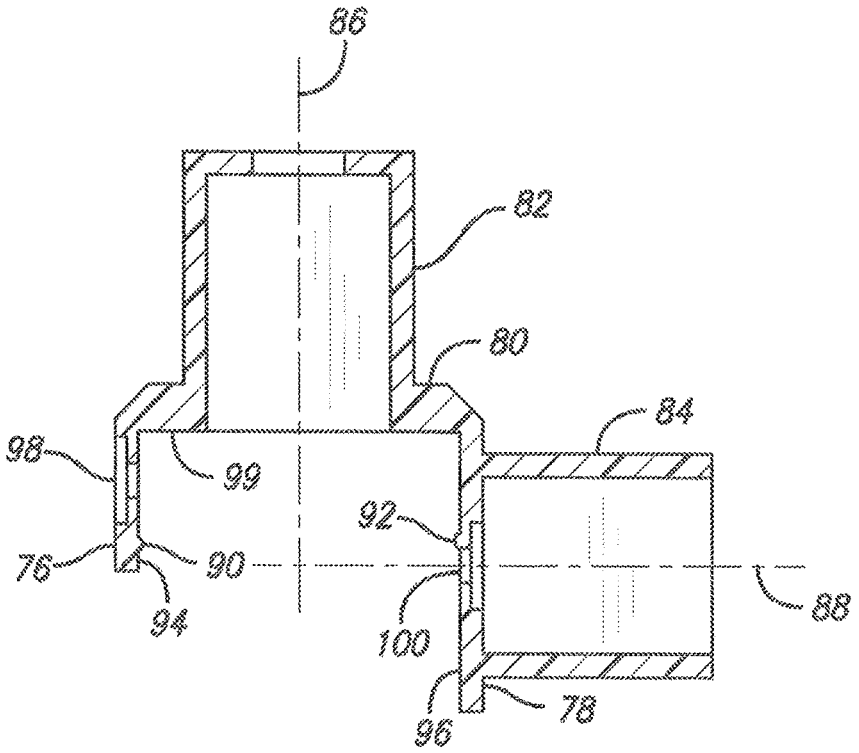
FIG. 6 is a cross-sectional view taken about the lines 6-6 of FIG. 5.

Referring now more particularly to FIGS. 5 and 6, there is disclosed a corner rail to post connector (72) which is utilized when a section of the fence is completed and a turn must be accomplished typically at 90 degrees to the preceding section of the fence and then continuing with the fence. As is shown in FIGS. 5 and 6 the corner rail to post connector (72) includes an additional generally U-shaped member (74). The U-shaped member (74) includes downwardly extending arms (76) and (78) which are interconnected with a bight section (80). It should be specifically noted that the arm (78) extends further away from the bight (80) than does the arm (76) and adapter (82) extends outwardly from the bight (80) and away from the arms (76) and (78). An additional adapter (84) extends outwardly from the arm (78) and as illustrated more specifically in FIG. 6 the axis (86) of the adapter (82) is disposed at an angle of 90 degrees to the axis (88) of the additional adapter (84). It is by this angular arrangement of the adapters (82) and (84) that a right-angle corner turn can be made in the fencing system of the present invention by utilizing the corner rail to post connector (72). A protuberance (90) extends from the inner surface (94) of the arm (76) while a protuberance (92) extends inwardly from the inner surface (96) of the arm (78). It should be noted that the protuberances (90) and (92) are arranged such that they are disposed the same distance from the inner surface (99) of the bight (80) and directly oppose each other. The arm (76) also defines an opening (98) therethrough while the arm (78) defines an opening (100) therethrough. The purpose and function of the protuberances (90) and (92) and the openings (98) and (100) will be described more fully below.

Figure 7:
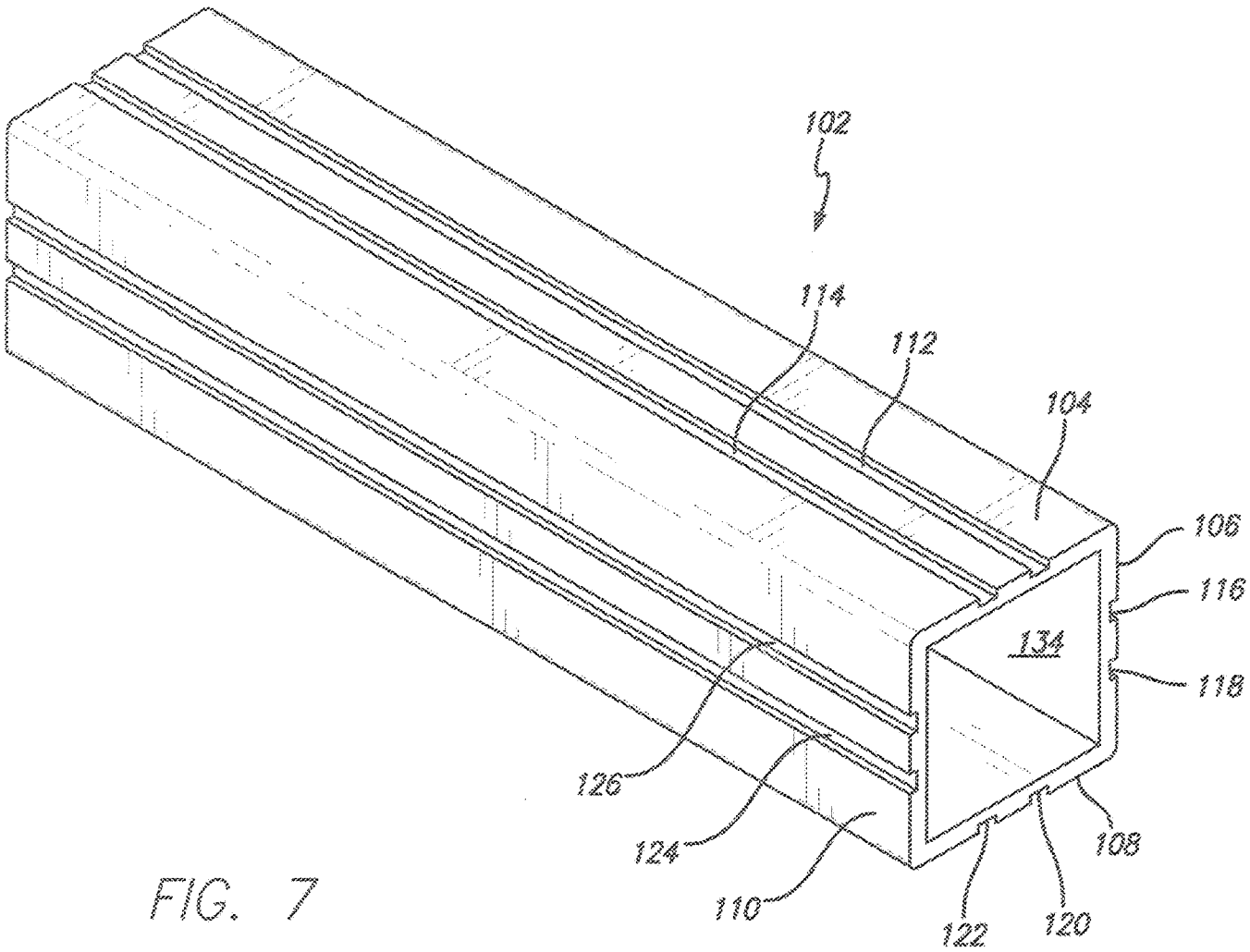
FIG. 7 is a perspective view of the elongated member which functions as a post or a rail on the fence of the present invention.

Referring now more specifically to FIG. 7, there is disclosed a hollow elongated member (102) which is formed of extruded plastic material. As is illustrated in FIG. 7, the hollow elongated member (102) preferably is rectangular in configuration and more specifically is square in cross-section and has outer surfaces (104) (106) (108) and (110). The outer surface (104) of the elongated member (102) includes a pair of spaced apart grooves (112) and (114) thereon. The outer surface (106) of the elongated member (102) includes a groove (116) and an additional spaced apart groove (118) thereon. The surface (108) of the elongated member (102) includes spaced apart grooves (120) and (122) thereon, while the surface (110) of the elongated member (102) includes spaced apart grooves (124) and (126) thereon. The elongated member (102) as shown in FIG. 7 is utilized in the snap together fencing system of the present invention to function as both posts for the fence and rails for the fence. Preferably the elongated member (102) would be extruded as a component having no specific length and would then be cut into lengths as required or desired for posts and rails.

By referring back to FIG. 1, it will be recognized that the elongated member (102) as illustrated in FIG. 7 can be positioned over the plug (30) and moved downwardly into the continuous cavity (42) to be seated against the top surface (14) of the flat plate (12). By being thusly positioned, the elongated member (102) would function as a post positioned upon the base (10) and would be erected upwardly to receive the other components forming the snap together fence system of the present invention.

By referring now to FIGS. 3 and 4, it will be recognized that the elongated member (102) as shown in FIG. 7 can be positioned over an adapter (58) so as to be seated against the bight (66) and would then function as a rail for the snap together fencing system of the present invention. In order to be positioned as a rail the straight rail to post connector (48) as illustrated in FIG. 3 would be positioned on an elongated member (102) which is functioning as a post for the snap together fencing system of the present invention. This would be accomplished by placing the arms (52) and (54) of the straight line connector (48) against the elongated member (102) and pressing the straight line connector against the elongated member (102) with sufficient force to allow the arms (52) and (54) to move slightly outwardly thus allowing the inner surface (57) of the bight (56) to engage the outer surface (104) of the elongated member (102). When this occurs, the protuberances (64) and (66) would be seated in grooves on the opposite sides of the elongated member; such, for example as the groove (116) in the surface (106) and the groove (126) in the surface (110) of the elongated member (102). This step would be repeated at whatever positions are desired along each of the posts which form the snap together fencing system of the present invention so as to provide rails at whatever level may be desired depending upon the height of the fence which is to be constructed utilizing the snap together fencing system of the present invention.

From the foregoing description of the utilization of the elongated member (102) for the posts and rails, it should be recognized by those skilled in the art that by constructing the elongated member (102) with the grooves being disposed in each of the four surfaces of the elongated member (102) no effort is required on the part of the person erecting the fence to do any alignment of any kind since the elongated member (102) may be utilized by positioning any of the sides in any position so long as the elongated member appropriately fits over the plug (30) in the base (12) or the adapter (58) in the straight rail to post connector (48).

In a similar manner to that described with regard to a straight rail to post connector, the corner rail to post connector would also be positioned upon an elongated member (102) functioning as a corner post. This would be accomplished by placing the arms (76) and (78) of the corner connector (72) as illustrated in FIGS. 5 and 6 against one of the surfaces such as (104) of the elongated member (102) as shown in FIG. 7. The arms (76) and (78) would then be forced slightly apart by applying the sufficient force required to do so, so that the inner surface (99) of the bight (80) of the corner connector (72) would be seated against the outer surface (104) of the elongated member (102). When such is done the protuberances (90) and (92) would be seated within grooves formed in the opposite surfaces of the elongated member (102) such as shown at (116) on the surface (106) and (126) as shown on the surface (110) of the elongated member (102) as illustrated in FIG. 7. When in such a position on the elongated member (102) functioning as a post, additional sections of the elongated member (102) as illustrated in FIG. 7 would be seated on the adapter (82) and the additional adapter (84) of the corner rail to post connector (72). These portions of the elongated member (102) would then be functioning as rails for the snap together fencing system of the present invention. When such is accomplished it will be seen by those skilled in the art that an elongated member (102) functioning as a rail would be affixed to the adapter (82) while an additional section of the elongated member (102) would be positioned upon the additional adapter (84) and would function as an additional rail but disposed at a 90-degree angle to the rail which is positioned upon the adapter (82).

Figure 8:
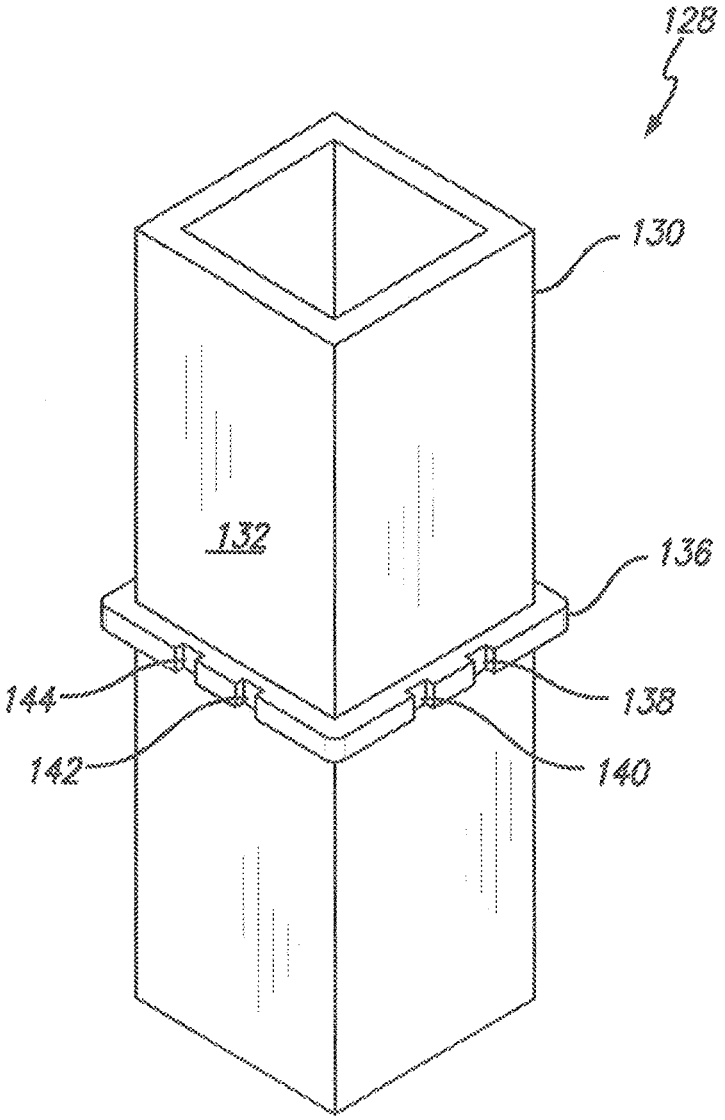
FIG. 8 is an inline extension connector used to emetic the post or rail.

In some instances it may be desirable to utilize sections of the elongated member (102) as shown in FIG. 7 which would otherwise be discarded because they are of insufficient length to function as either a post or rail. In such instances, it would be desirable to piece together these parts of the elongated member (102) so that they could be utilized as either a post or a rail. To accomplish this, there is provided as one of the components of the snap together fence system of the present invention an in-line extension connector as is shown in FIG. 8. The in-line extension connector as shown at (128) is formed of injection molded plastic and includes a hollow tube-like member (130) having an outer surface (132) which is dimensioned to be received within the hollow elongated member (102) as shown in FIG. 7. That is, the outer surface (132) would have a dimension such that the hollow tube would fit within the opening (134) of the elongated member (102) as shown in FIG. 7. The hollow tube (130) includes an outwardly extending flange (136) which includes grooves on each of the four surfaces thereof; such, for example, as shown at (138) and (140) and also (142) and (144). The grooves formed on each portion of the flange (136) are dimensioned such that they mate with the grooves which are formed on the elongated member (102) as shown in FIG. 7. The width of the flange (136) is also dimensioned such that when the hollow tube-like member is inserted into the opening (134) and the elongated member (102) the outer surface of the flange (136) will mate with the dimensions of the elongated member (102). As a result, when the sections of the elongated member (102) which are to be utilized as an extension of a rail or a post are put together utilizing the in-line extension connector as shown in FIG. 8, the resulting structure will permit utilization of the other components of the snap together fence system such as the straight rail to post connector and the corner rail to post connector (48) and (72), respectively as above-described.

Figure 9:
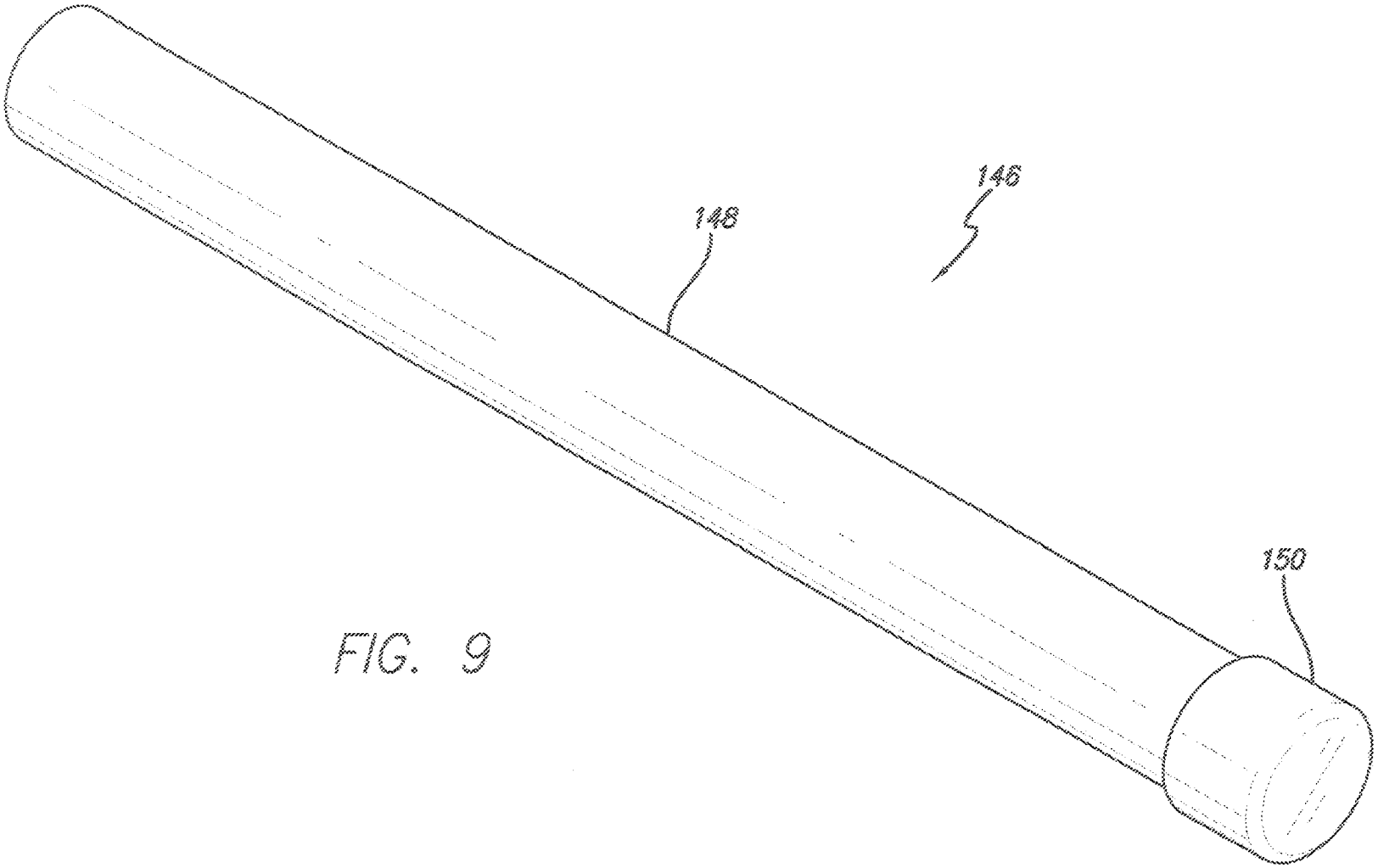
FIG. 9 is a stake used to secure the base to the ground.

In some instances, it may be desirable to utilize the base (10) as shown in FIG. 1 in an open field or other area and it may be desirable to anchor the base to the ground. When such is to be desired, a stake such as shown at (146) in FIG. 9 may be utilized. The stake (146) has a body (148) which is dimensioned to fit within the opening (44) in the plug (30) of the base as shown in FIG. 1. An appropriate cap or top (150) is placed on the end of the stake (146) for the purpose of permitting the person erecting the snap together fencing system of the present invention the ability to utilize a hammer or the like to drive the stake (146) into the ground and downwardly until the cap (150) engages the top (46) of the plug (30). In this manner, the base would be securely anchored to the ground in a very simple and easy to utilize manner.

The individual erecting the snap together fence system of the present invention may also use an elongated member as a post by driving the elongated member directly into the ground. If desired, the end of the member to be inserted into the ground may be cut at an angle to provide a sharp portion to enable easier insertion of the elongated member into the ground.

Figure 10:
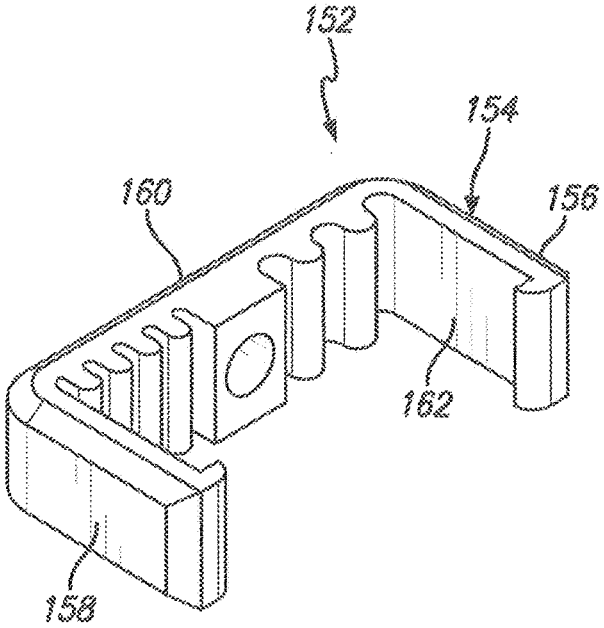
FIG. 10 is a clip utilized to retain the fencing material on the post or rails.
Figure 11:
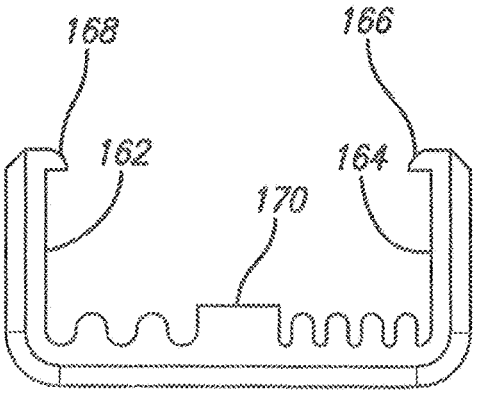
FIG. 11 is a side view of the clip as shown in FIG. 10.

Once the post and rails are erected utilizing the snap together components of the fencing systems of the present invention, it is desirable in some instances to place a wire fencing material along the posts and rails, and it will be necessary to secure the wire fencing to the posts and rails. To accomplish this, a clip (152) as shown in FIGS. 10 and 11 may be utilized. The clip (152) is a generally U-shaped member (154) having a pair of arms (156) and (158) and a bight (160). The opposed inner surfaces (162) and (164) of the arms (156) and (158), respectively include protuberances (166) and (168) in the form of a ridge-like member. These protuberances or ridges (166) and (168) are utilized to engage the grooves formed in the outer surfaces of the elongated member (102). The clip (152) would be placed against one of the surfaces such as shown at (104) in FIG. 7 of the post or rail as may be desired and then sufficient force applied to cause the arms (162) and (164) to move outwardly to allow the clip to moved forwardly and for the protuberances (166) and (168) to engage the grooves on the opposite sides of the elongated member (102); such, for example, as the grooves (116) and (126) in the surfaces (106) and. (110), respectively. In this manner, the clip (152) would be securely connected to the post or rail and when such is done the fencing material would then be captured within one of the plurality of grooves formed on the surface (170) of the clip (152). It should be noted that these grooves are of different dimensions in order to receive fencing material having different diameters.

Figure 12:
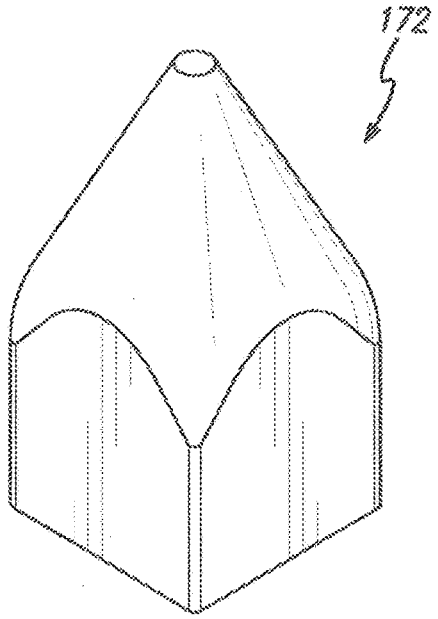
FIG. 12 is one embodiment of a cap that can be utilized to place on the top of the post.
Figure 13:
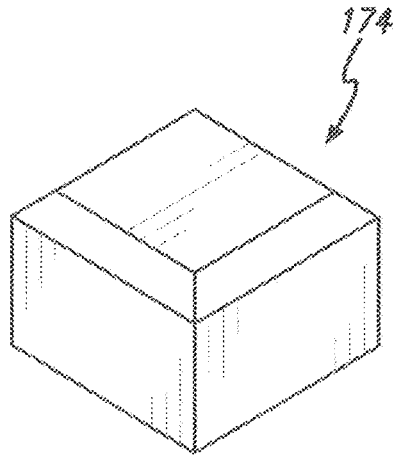
FIG. 13 is alternative embodiment of such a cap.

In order to make the appearance of the posts, which are utilized in accordance with the snap together fence of the present invention to be more esthetically pleasing, there is provided a top (172) as shown in FIG. 12 which is dimensioned so as to slip over the outer surface of the elongated member (102) which is assembled to function as a post. Alternatively, the member may be a cap as shown at (174) in FIG. 13 depending upon the esthetic appearance desired by the person erecting the snap together fence system of the present invention. Again the cap (174) will be dimensioned an as to slip over the outer surface of the elongated member (102) which is utilized as the post in the fencing system of the present invention.

Figure 14:
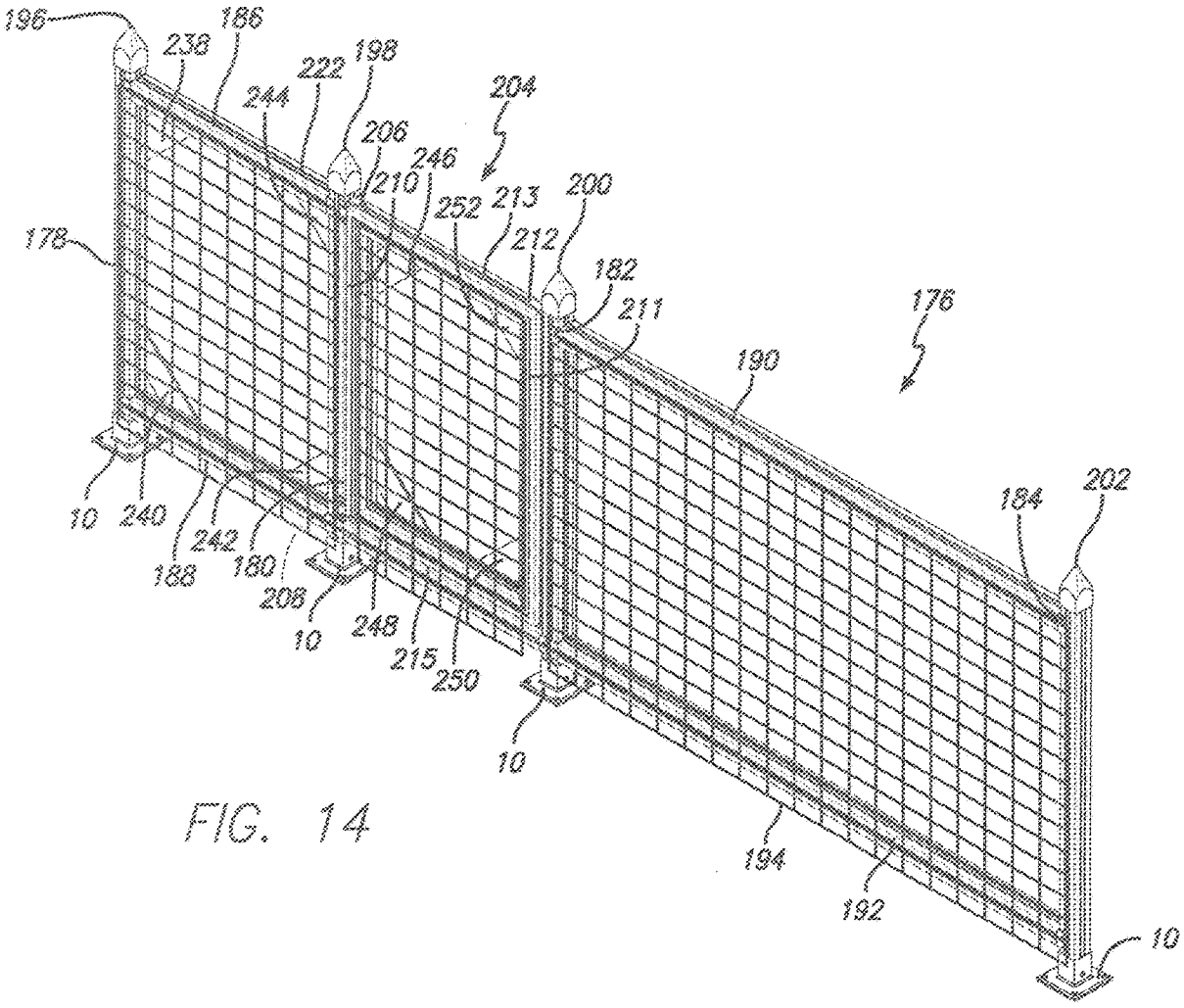
FIG. 14 is a side elevational view of a section of fence constructed using the snap together system of the present invention.

Referring now more particularly to FIG. 14, there is illustrated a section of fence utilizing the various components of the snap together fence system as described above. As is shown, bases (10) are placed upon the surface upon which the fence is to be erected. Elongated members such is shown at (178), (180), (182) and (184) are positioned to be inserted into the hollow risers of the bases as illustrated in FIG. 1 and function as posts. Additional members (186) (188) (190) and (192) are connected to the posts by utilizing the straight rail to post connector as above-described so that they function as rails connected to the respective posts. A wire fencing material (194) is then attached to the posts and rails utilizing clips as above described or alternatively additional fasteners such as screws could be utilized to accomplish the attachment of the fencing material (194) to the rails and posts. The posts (178) through (184) may be fitted with the top (172) as shown in FIG. 12 and as is illustrated at (196), (198), (200) and (202) for the posts (178), (180), (182) and (184), respectively.

It may also be desirable to provide a gate as illustrated at (204) of FIG. 14. The gate (204) includes a gate post (210) and (211), a top rail (213) and a bottom rail (215). The top and bottom rails (213) and (215) are secured to the top and bottom of the gate posts (210) and (211) by appropriate connectors. The gate would be pivoted by appropriate pivot connectors (206) and (208) which would fit into the gate post (210). When the latch (212) is opened by pivoting it upwardly as viewed in FIG. 14, the gate may then be pivoted about the pivot carried by the pivot connectors (206) and (208) to open the same to allow ingress or egress as may be desired.

Figure 15:
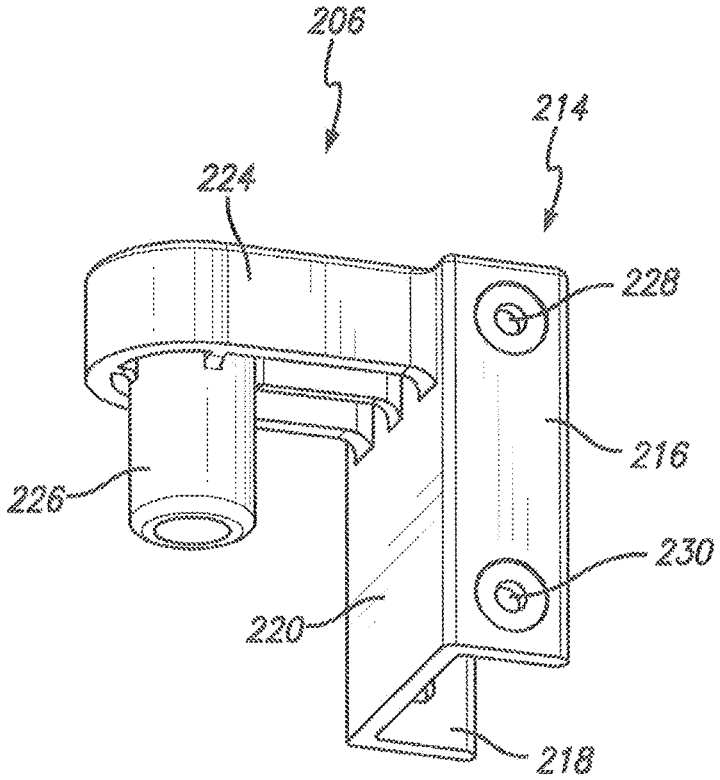
FIG. 15 is a partial perspective view of the area (15) of FIG. 14 illustrating the pivot portion of a gate.

Referring now more particularly to FIG. 15, a pivot or hinge member for the gate is illustrated in greater detail. As is therein shown, the pivot connector (206) is formed by providing a generally U-shaped member (214) which has arms (216) and (218) extending outwardly and away from the bight (220) there between. Protuberances (not shown) similar to those provided on the straight line connector at (64) and (66) are also provided on the inner surfaces of the arms (216) and (218). The pivot connector (206) is positioned on the post (180) adjacent the top of the gate post (210) by forcing the arms slightly apart so that the arms slip downwardly so that the post (180) rests against the bight (220) and the protuberances formed on the interior surface of the arms (216) and (218) fit within the groove (222) on the post (180) and on a similar groove formed on the opposed outer surface of the post (180). Extending outwardly from the bight (220) in a direction opposite to the arms (216) and (218) is a support member (224) which includes a downwardly directed pivot pin (226). The pivot pin fits into an opening provided in the top of the gate post (210). By referring again to FIG. 14, it will be recognized by those skilled in the art that the pivot connector (208) is constructed in the same manner as just described for the pivot connector (206), but when being positioned on the post (180) adjacent the bottom end of the gate post (210) the support member will be located at the bottom with the pivot pin facing upwardly to be received within an opening in the bottom of the gate post (210). When the gate is positioned on the pivot connectors (206) and (208) and properly positioned as desired, fasteners may be inserted into the openings as shown at (228) and (230) to secure the same firmly in place. Alternatively, an adhesive may be used to secure the pivots in place.

As will be recognized by those skilled in the art, when a gate such as shown at (204) in FIG. 14 is provided in a fencing structure, additional forces are applied to the fencing system. To keep those forces from having deleterious effects to the fencing system, appropriate braces must be provided, such as shown as (238), (240), (242), (244), (246), (248), (250) and (252). Each of these braces would be formed providing surfaces thereon to be positioned against the post and adjacent rail on the fence or on the gate and are then secured in place by screws or other fastening material.

Figure 16:
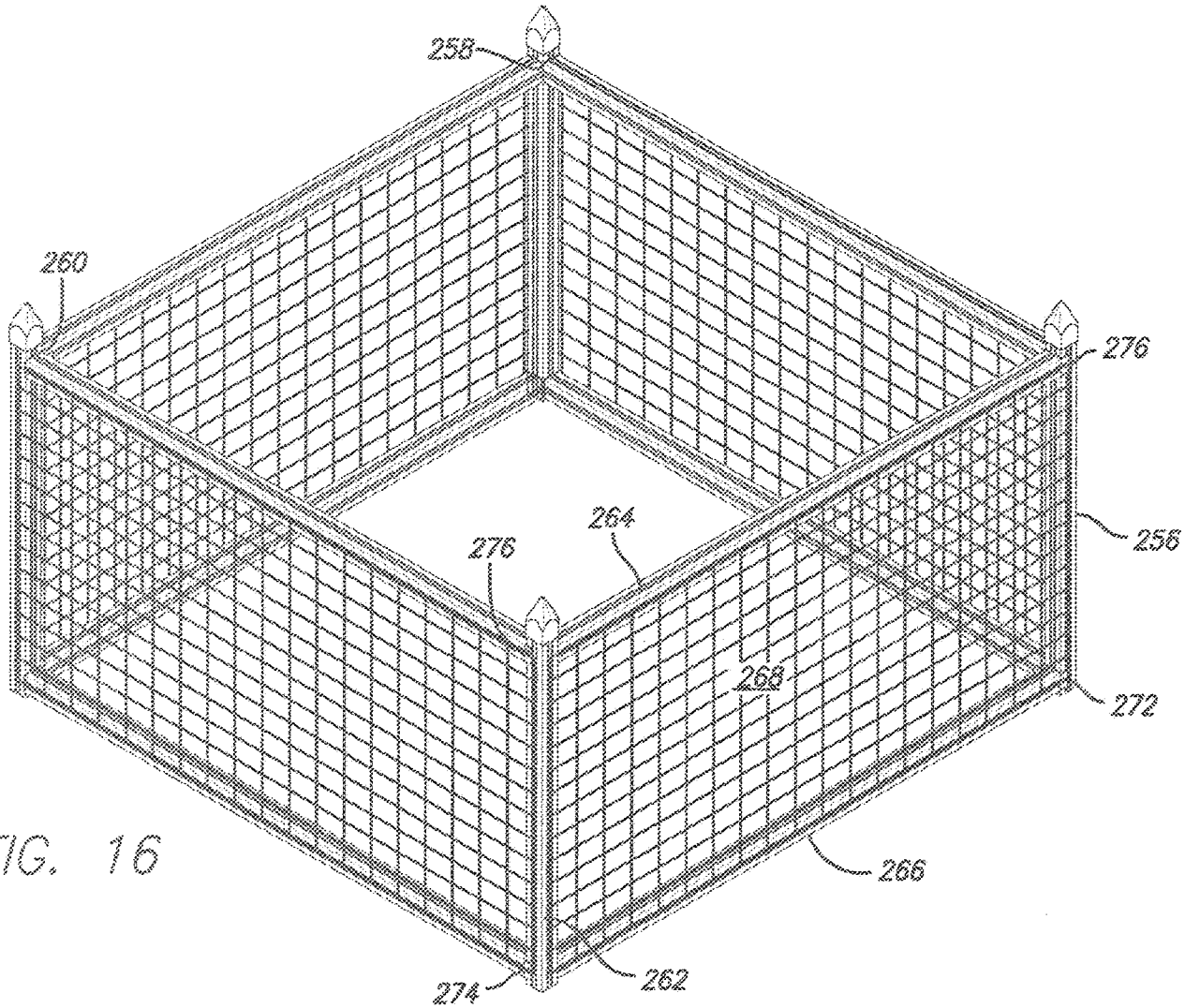
FIG. 16 is a schematic representation of an area being enclosed by the snap together fence system of the present invention.

Referring now more particularly to FIG. 16, there is illustrated in schematic form a small area enclosed by a snap together fencing system constructed in accordance with the principles of the present invention. As is illustrated in FIG. 16, each of the posts (256), (258), (260) and (262) is a corner post. Each of the fencing sections between the posts would have upper and lower rails, for example such as shown at (264) and (266) for the fencing section (268). The other sections would be similarly constructed. To support the rails (264) and (266) there would be provided on the posts (256) and (262) a plurality of corner rail to post connectors constructed as shown in FIG. 5. Each of these corner rail to post connectors would be mounted on the posts in the positions to receive the upper and lower tails of each of the fence sections thus permitting the fence to be turned 90 degrees at each of the posts (256), (258), (260) and (262). The purpose of the illustration in FIG. 16 is merely to illustrate the utilization of the cornet rail to post connectors to provide the 90-degree turn for a section of fence and that an appropriate fence can be constructed enclosing a desired area to contain small animals or keep small animals away. The sections of the fence as shown in FIG. 16 may be of any length as desired with the straight portions of the fence constructed in the manner illustrated in FIG. 14 and above-described.

The fence as shown in FIG. 16 is erected without the use of the base member as described in FIGS. 1 and 2. The lower rails as shown at (266) are placed directly on the ground or the other support surface and are held in place by connectors snapped into place on the parts.

There has thus been disclosed a fencing system which may be constructed by an individual utilizing a minimum of parts, constructed of plastic material, which can be assembled by do-it-yourself individuals relatively quickly and simply by merely snapping together the particular component parts to provide the posts, rails and connectors to support the rails on the posts. As the various rails are being connected to the straight line and corner rail to post connectors or the extension connector, they may be more permanently and positively secured in place through utilization of an appropriate adhesive or alternatively, as pointed out at various portions in the specification, through the utilization of fasteners such as screws positioned through the openings as shown at (66) and (68) in FIG. 3 and (98) and (100) in FIG. 5.

In an alternative embodiment, the present invention snap together fence system may be used as a frame for building a block wall or any barrier-like structure. Building a block or concrete wall is intimidating and requires a high degree of skill level; therefore, it is not usually attempted by the common homeowner, a Do-It-Yourself builder, or even a general contractor not experienced in this type of work. The concrete or block wall building process involves heavy concrete footings with exacting leveling parameters, heavy blocks, mortar, rebar, some type of heavy concrete cap as well as wall the wall finish. The installation of conduit into the masonry wall for electrical lines for lights and exterior electrical receptacles as well plumbing for irrigation or hose bibs is difficult and challenging even for those knowledgeable in these areas. Extensive tools, equipment, knowledge, labor and the skills listed above are required for even the smallest of projects.

The present invention snap together fence system can be adapted as a frame or foundation for building a wall. The construction can be accomplished by a Do-It-Yourself builder without special tools or a lot of training in the construction trade.

Figure 18:
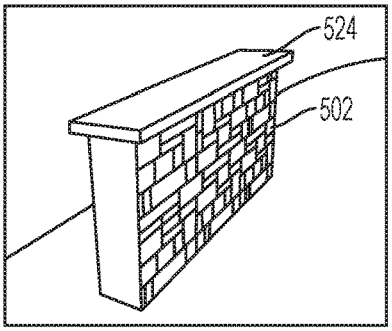
FIG. 18 is another view of the wall of FIG. 17.
Figure 19:
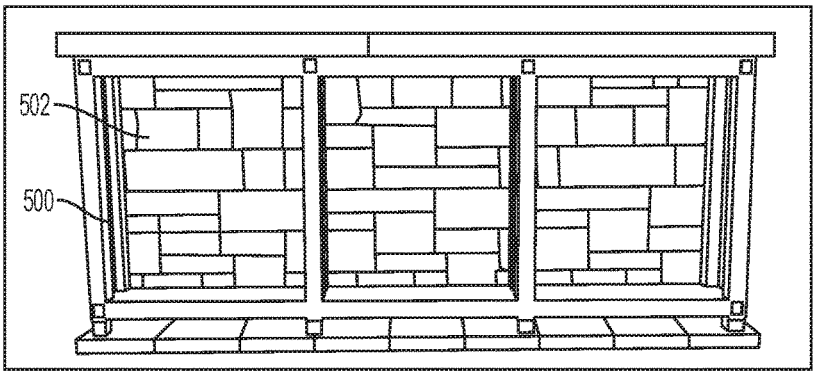
FIG. 19 is a view of the snap together tubing system supporting the wall of FIGS. 17-18.
Figure 20:
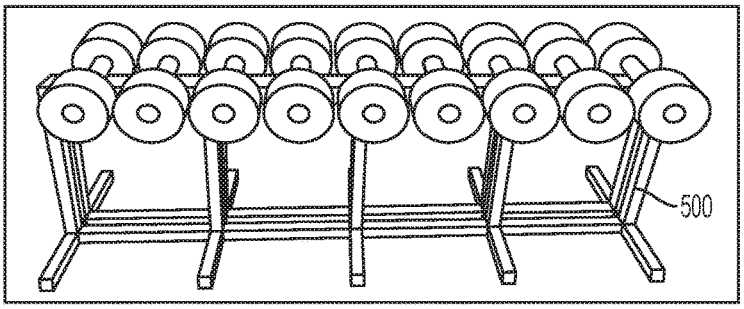
FIG. 20 is an embodiment of the snap together tubing system support dumbbells.

FIGS. 17-24 depict a preferred embodiment snap together tubing system used to support a wall or like vertical structure (502). In a preferred embodiment seen in FIGS. 19, 20, 21, all parts fit into a universal one-size-fits-all square tubing system (500) that makes up the horizontal, vertical members as well as the horizontal spacers and ground anchor. In order to make the tubing system (500) universal for all the parts, it is preferably designed to be square and of sufficient strength (i.e., wall thickness, bending and column strength) so as to be able to adequately accommodate different vertical and horizontal loads that are required of this part. For example, FIG. 20 depicts the preferred embodiment tubing system (500) formed into a lattice structure that is supporting dumbbells weighing over 1000 lbs.

The tubing system (500) employs the tubing and structures disclosed in detail above. All components are preferably made from a molded polymer, but fiberglass, wood, metal or the like can be used. A single part can be made from different materials as well.

All the adapters (504) of the parts fit into the square tubing (508) so that a preferably smooth outside face can be presented. Without the parts fitting into the tube (508), a smooth outside surface would not be possible. Hence, attachment of a wall or flat sheet backer board (502) for the facade of the wall would be more complicated. Inserting the adapters (504) of the part into the tube (508) as opposed to the part on the outside of the square tube preferably requires that the tubing inside dimension be preferably consistent and exact.

Figure 21:
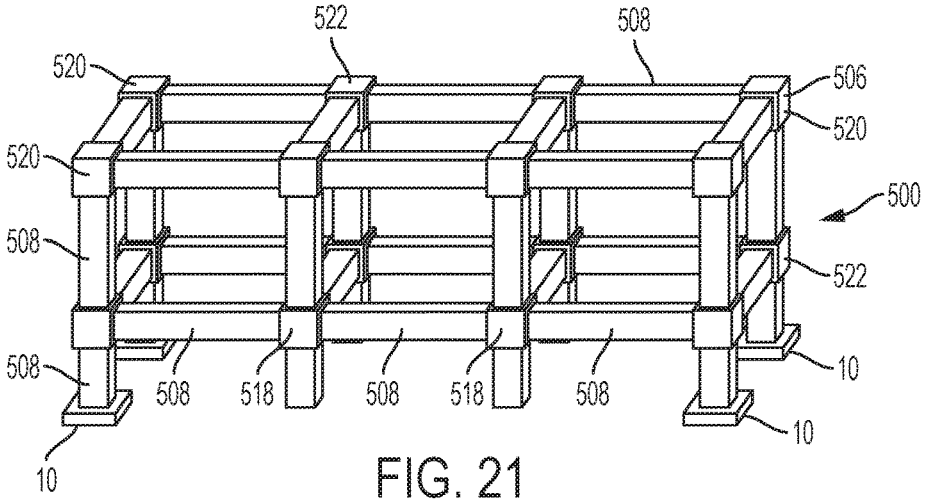
FIG. 21 is a preferred embodiment snap together tubing system arranged in a six-sided lattice.
Figure 22:
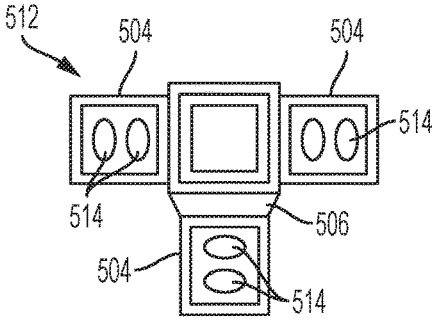
FIG. 22 is a top plan view of a T-fitting with rebar passing through its plug adapters.
Figure 23:
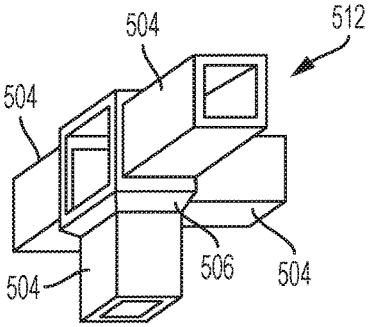
FIG. 23 is a perspective view of a four-way T-fitting.
Figure 24:
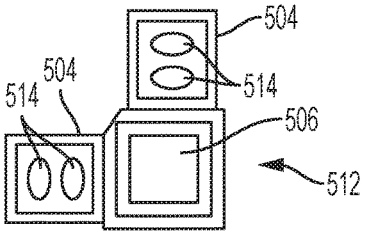
FIG. 24 is a top plan view of a two-way elbow fitting receiving rebars inside the plug adapters.

FIGS. 22, 23, and 24 depict preferred embodiment fittings (512). Each elbow FIG. 24 or T-shaped FIG. 23 fitting (512) has a bite (506) with zero, one or more adapters (504) extending from one or more faces of the bite (506). One or more of the plug adapters (504) may be arrange preferably in parallel or at right angles to each other. All fittings (512) have universal plug adapters (504) that fit into the tubing (508). FIG. 23, for example, is a four-way T-shaped fitting, while FIG. 24 illustrates a two-way elbow fitting. There can be alternative embodiments of one-, two-, three-four-, or five-way T-shaped fittings, and one-, two-, three-, or four-way elbow fittings. The parts are designed so they can be faced in different positions for multipurpose and multidirectional applications. FIG. 21 shows a six-sided lattice frame assembled from a combination of such tubing and fittings. The embodiment shows three lattice frames arrange in sequence, but of course one single six-sided lattice is contemplated.

Figure 25:
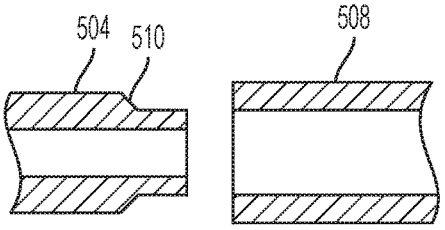
FIG. 25 is a partial cross-sectional view of a plug adapter with a step prior to insertion inside the tube.

The plug adapters (504) of each part are preferably two-staged for compression fit and designed to start into the tube (508) easily then lock in tight via friction or interference fit. This is illustrated in FIG. 25, showing cross-sections of an adapter (504) having a step (510) in an outer surface or outside dimension and the corresponding receiving end of a tube (508). By using a two-stage fitting (i.e., two-step outside surface (510)) on each adapter (504) of the part, no tools are necessary for assembly or to hold the parts together.

Figure 26:
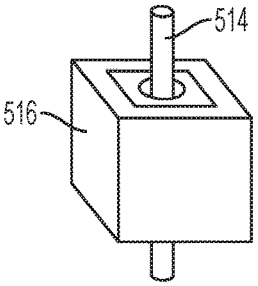
FIG. 26 is a perspective view of a rebar receptacle.

The preferred embodiment wall system includes at least three fittings (512) that are hollow and have the same inside and outside adapter (504) dimension that fit into the hollow universal tubing (508). These adapters (504) are designed to be hollow and fit into the hollow tubing. As seen in FIGS. 22, 24, the hollow interior or the fittings (512), adapters (504), and tubing (508) allow one or more structural steel rebar rods or wires (514) to be inserted from the top of the tube (508) all the way through the square tube (508), fittings (512), ground anchors (10) and optional rebar receptacle (516) to the ground and concrete level. The optional rebar receptacle (516) shown in FIG. 26 is preferably a square sleeve that fits inside the tubing (508), fitting (512), or anchor (10) to receive the rebar rod (514) inside.

The ground anchor (10) shown in FIG. 1 is what attaches the wall tubing system (500) to the ground/concrete. When building a traditional wall, a footing must be dug along the entire length of a wall. The below-ground concrete footing of a typical concrete/block wall not only ensures the integrity of the above-ground portion of the wall but the levelness of the wall along its entire length. This is a very complex construction process.

On the other hand, the present invention snap-together wall tubing system (500) is much simpler. In the preferred ground anchor process: [1] individual holes are dug for every two ground anchors (10); [2] the frame with ground anchor attached is assembled; [3] the frame with ground anchor attached is put into the hole leveling as the wall is being built; [4] if necessary a steel rebar rod is added; and [5] fill the holes with concrete. The basic snap-together wall tubing system (500) is now complete.

Figure 17:
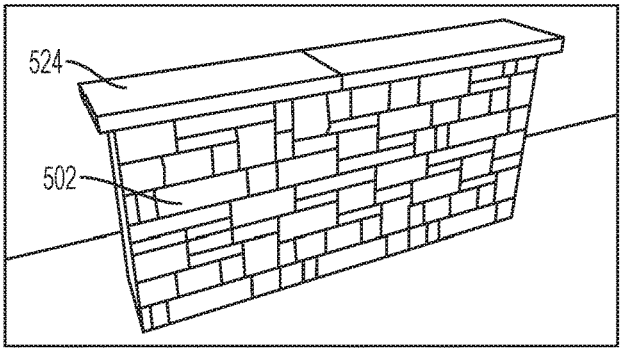
FIG. 17 is a perspective view of a wall constructed using the snap together tubing system.

As seen in FIG. 17-19, to create the wall or façade (502), a flat sheet backer board commonly available on the market (e.g., https://www.jameshardie.com/) can be ordered off-the-shelf and attached to the wall tubing system (500) using screws, fasteners, adhesives, or through well-known construction techniques.

If rebar (514) is not necessary and the ground anchor (10) is attached and the wall tubing system (500) is level in the ground, concrete is poured into the holes. The basic wall frame is now complete. If rebar (514) is necessary for further structural support and strength, the proper sized rebar receptacle (516) is inserted into the fitting (512) while building the wall frame. Once the tubing system (500) is complete and level in the ground, the rebar (514) is pushed from the top of the tubing (508) through the fittings (512) and tubing through the ground anchor (10) with the optional rebar receptacle (516) and into the ground and concrete below.

FIG. 21 illustrates usage of a 5-way cross fitting (518). This component attaches the ground anchor to the horizontal and vertical members of the frame. As the wall increases in height and more horizontal and vertical framing becomes necessary, this part attaches the horizontal tubing rails determining the width of the wall and the rail and the vertical post which determines the height of the wall. This part provides the basis of support for the rebar receptacle (which is inserted into the appropriate adapters) so the rebar can pass through from the top of the wall through the ground stake and into the ground/concrete below. The advantage of using two 5-way cross and a separate spacer joining them together is that the depth or the thickness of the wall becomes indeterminate which gives the engineer complete flexibility as to thickness or depth of the wall desired. Optionally, a molded 5-way cross is molded with the square tubing with the same dimensions as the separate piece creating width or thickness to another 5-way cross. This combines three separate parts and molds them into one part. All dimensions and functions are the same as if three parts separate parts were used. The molded 5-way cross will result in fixed depth or thickness of wall.

In FIG. 21, the 4-way tee fitting (522) is used to attach the horizontal tubing rails and the vertical posts together. The 4-way tee also attaches the ground anchor to the rest of the frame at the beginning and end of each wall section. As the wall increases in height and more horizontal and vertical framing becomes necessary, this part attaches the horizontal rails which determine the thickness or depth of the wall and the vertical post which determines the height of the wall. The 4-way tee provides the basis of support for the rebar receptacle (which is inserted into the appropriate adapters) so the rebar can pass through from the top of the wall through the parts and into the ground/concrete below. The advantage of using two 4-way tees and a separate spacer joining them together is that the thickness/depth of the wall becomes indeterminate which gives the engineer complete flexibility as to thickness of the wall desired. Optionally, a molded 4-way tee is molded with square tubing with the same dimensions as the separate piece creating fixed width/thickness to another 4-way tee. This would combine three separate parts molded into one. All dimensions and functions are the same as if three separate parts were used. The molded 4-way tee will result in fixed depth or thickness of wall.

In FIG. 21, a 3-way elbow fitting (520) attaches the horizontal tubing rails and the vertical post together at the top end of a wall. The 3-way elbow finishes the top of a wall with a flat surface. It provides a basis of support for the rebar receptacle (which is inserted into the appropriate adapters). The rebar can pass through from the top of the wall through the parts and into the ground/concrete below. An advantage of using two 3-way elbows and a separate spacer joining them together is that the thickness/depth of the wall becomes indeterminate which gives the engineer complete flexibility as to thickness of the wall desired. Optionally, a molded 3-way elbow is molded with square tubing with the same dimensions as the separate piece creating fixed width or thickness to another 4-way elbow. This would combine three separate parts molded into one. All dimensions and functions are the same as if three separate parts were used. The molded 4-way tee will result in fixed depth or thickness of wall.

The 5-way cross, 3-way tee and the 4-way tee fittings are all designed preferably with uniform adapters for a universal fit. The rebar receptacle (516) fits inside of all adapters for all three parts. The rebar receptacle fits inside the adapter and slips inside the square tubing, there is no interference. The rebar receptacle not only acts as a conduit for rebar, but also significantly strengthens the primary fitting. This part can be used as a standalone strengthening application for all the parts without the use of rebar. The rebar receptacle is preferably manufactured with pre-sized holes of different diameters matching common rebar diameters. The rebar receptacle provides a tight fit for the appropriately sized rebar in the middle of the receptacle. The rebar receptacle will keep the rebar straight and prevent movement from any outside shearing forces exerted against the wall. Not all applications require rebar. If rebar is required (the parts are multidirectional) not every adapter of the same part requiring rebar will need the rebar receptacle. The only adapter of a given part requiring the rebar receptacle are those where the rebar passes directly through them. In very heavy application the parts can be filled with mortar or industrial foam.

As seen in FIGS. 17, 18, a cap or wall topper (524) optionally adds the finishing touches to the top of the wall (502). In a conventional concrete, stone or like wall, the cap or wall topper is preferably a precast masonry topper or poured in place concrete. Securing these caps in place is a heavy, labor intensive effort requiring skills that the average homeowner, do-it-yourselfer, or even most general contractors do not have. On the other hand, the present invention system (FIG. 19) presents a flat horizontal surface at its top that can utilize and accept many different types of off-the-shelf fasteners and glues, which enables many cap (524) options that would be otherwise very difficult to affix to a conventional masonry wall. An example would be wood-like composite caps. These composites as well as a backer board cap are easily applied by the unskilled homeowner or contractor to the snap together tubing system (500) using simple screws, fasteners, or adhesives. Even intricate and highly ornamental caps made from plastics, fiberglass, etc. can be easily installed, whereas a highly skilled artisan would be needed to create and install such a cap on a conventional masonry or brick wall.

Similar to that shown in FIGS. 17-19, based on the snap-together tubing system (500), one or more pilasters, columns, or pillars may be created or selected and attached to the wall. The pilaster provides further support for the rigidity and strength of the wall, and/or may function as ornamentation to enhance the wall's appearance. A pilaster is generally defined as an architectural member preferably square in shape (but can be a cylinder, etc.) that projects itself in width that is greater than the width of the wall itself. The preferred embodiment pilaster is made up of the following parts that are used in the same manner as described above: 3-way elbows, 4-way tee and 5-way cross fittings inserted into the square tubing.

Also, the snap together tubing system (500) preferably have hollow centers including the pilaster, which is a great advantage over typical masonry pilasters, because a light fixture or lamp of some kind is usually mounted on top of pilaster. The hollow but incredibly strong wall/pilaster tubing (508) makes running electrical lines through the wall and up to the top of the pilaster a very simple endeavor, as opposed to a conventional, solid masonry wall and a solid concrete cap where a hollow core must be molded or created therein by drilling.

While the invention has been described in detail above, it should be understood by those skilled in the art that various modifications may be made without departing from the spirit and scope of the invention. Accordingly, it is to be understood that the invention is not to be limited by this specific illustrated embodiment, but only by the scope of the appended claims.

What is claimed is:

1. A tubing system for supporting a board wall, comprising:

a hollow elongated member formed of extruded plastic material and defining grooves on an external surface thereof;

a straight rail to post connector formed of injection molded plastic material, said straight rail to post connector including:

a first generally U-shaped member having arms interconnected by a bight, a first, hollow adapter plug extending outwardly from the bight of said first U-shaped member and away from the arms of said first U-shaped member;

a corner rail to post connector formed of injection molded plastic material, said corner rail to post connector including:

a second generally U-shaped member having arms interconnected by a bight, a second, hollow adapter plug extending outwardly from the bight of said second U-shaped member, and away from the arms of said second U-shaped member, and a third, hollow adapter plug extending outwardly from an outer surface of one of the arms of said second U-shaped member;

said hollow elongated member when forming a post being adapted to receive said adapter plugs of the connectors therein, and also being adapted to receive said adapter plugs on said connectors therein to form rails, said arms on said connectors being adapted to receive said elongated members therebetween; and a flat sheet backer board affixed to the exterior surface of the hollow elongated member.

2. The tubing system of claim 1, wherein at least one of the first, second, and third adapter plugs includes a step on an outside surface.

3. The tubing system of claim 1, wherein a rebar rod passes through the hollow elongated member and at least one adapter plug.

4. The tubing system of claim 1, wherein the tubing system further comprises an elongated cap affixed to the hollow elongated member.

5. A tubing system for supporting a board wall, comprising:

a base including a plastic material, said base including:

a flat plate having a top and bottom surface, and a hollow riser extending upwardly from the top surface of said flat plate;

a hollow elongated member including a plastic material and defining grooves on an external surface thereof;

a straight rail to post connector including a plastic material, said straight line connector including:

a first generally U-shaped member having arms interconnected by a bight, a first, hollow adapter plug extending outwardly from the bight of said first U-shaped member and away from the arms of said first U-shaped member;

a corner rail to post connector including a plastic material, said corner rail to post connector including:

a second generally U-shaped member having arms interconnected by a bight, a second, hollow adapter plug extending outwardly from the bight of said second U-shaped member, and away from the arms of said second U-shaped member, and a third, hollow adapter plug extending outwardly from an outer surface of one of the arms of said second U-shaped member;

said hollow elongated member when being adapted to be received within said hollow riser to function as a post, and when adapted to receive said adapter plug on said connectors therein to function as a rail, said arms on said connectors being adapted to receive said elongated members therebetween; and a flat sheet backer board affixed to the exterior surface of the hollow elongated member.

6. The tubing system of claim 5, wherein the tubing system further comprises a rebar rod passing through the base, elongated member, and at least one adapter plug.

7. A tubing system for supporting a board wall, comprising:

a base including a plastic material, said base including:

a flat plate having a top and bottom surface, and a hollow riser extending upwardly from the top surface of said flat plate;

a hollow elongated member including a plastic material and defining grooves on an external surface thereof;

a straight rail to post connector including a plastic material, said straight line connector including:

a first generally U-shaped member having arms interconnected by a bight, a first, hollow adapter plug extending outwardly from the bight of said first U-shaped member and away from the arms of said first U-shaped member;

a corner rail to post connector including a plastic material, said corner rail to post connector including:

a second generally U-shaped member having arms interconnected by a bight, a second, hollow adapter plug extending outwardly from the bight of said second U-shaped member, and away from the arms of said second U-shaped member, and a third, hollow adapter plug extending outwardly from an outer surface of one of the arms of said second U-shaped member;

said hollow elongated member when being adapted to be received within said hollow riser to function as a post, and when adapted to receive said adapter plug on said connectors therein to function as a rail, said arms on said connectors being adapted to receive said elongated members therebetween;

a plurality of said hollow elongated members, straight rail to post connectors, and corner rail to post connectors are arranged horizontally and vertically to create a six-sided lattice; and a flat sheet backer board attached to the six-sided lattice.

8. The tubing system of claim 7, wherein the system further comprises a wall topper affixed to the six-sided lattice.

9. The tubing system of claim 7, wherein steel rebars pass through the four hollow elongated members arranged vertically.

10. The tubing system of claim 7, wherein the respective fittings include a 3-way elbow, a 4-way tee, and a 5-way cross.

11. The tubing system of claim 7, wherein at least one plug adapter includes a step in an external surface.

* * * * *